US006081073A

United States Patent [19]

Salam

[11] Patent Number: 6,081,073

[45] Date of Patent: Jun. 27, 2000

[54] MATRIX DISPLAY WITH MATCHED SOLID-STATE PIXELS

[75] Inventor: Hassan Paddy Abdel Salam, London, United Kingdom

[73] Assignee: Unisplay S.A., Geneva, Switzerland

[21] Appl. No.: 08/705,110

[22] Filed: Aug. 29, 1996

Related U.S. Application Data

[63] Continuation-in-part of application No. 08/575,067, Dec. 19, 1995, abandoned.

[51] Int. Cl.[7] ..... H05B 37/02

[52] U.S. Cl. ..... 315/169.2; 315/158; 345/55

[58] Field of Search ..... 315/307, 308, 315/149, 158, 159, 152, 312, 294, 169.3, 167, 169.1, 169.2; 345/76, 77, 55

[56] References Cited

U.S. PATENT DOCUMENTS 4,825,201 4/1989 Watanabe et al. ..... 340/717
5,262,698 11/1993 Dunham ..... 315/169.1
5,428,265 6/1995 Booth, Jr. et al. ..... 315/158
5,594,463 1/1997 Sakamoto ..... 345/76
5,717,417 2/1998 Takahashi ..... 345/82

FOREIGN PATENT DOCUMENTS 7-199861 12/1995 Japan .

OTHER PUBLICATIONS

PCT International Search Report in International Application PCT/GB 97/01315; dated May 2, 1998.

*Primary Examiner*—David H. Vu
*Attorney, Agent, or Firm*—Watson Cole Grindle Watson, P.L.L.C.

[57] ABSTRACT

A display matrix having LED lamps is arranged so that brightness variations between the lamps, due to the lamps having different characteristics from each other, is reduced. A process for setting up the display using an electronic camera is described. The system is arranged so that the brilliance of the lamps is automatically maximised when the sun is shining on the face of the display.

20 Claims, 4 Drawing Sheets

MATRIX DISPLAY WITH MATCHED SOLID-STATE PIXELS

This application is a Continuation-in-Part application of application Ser. No. 08/575,067, filed Dec. 19, 1995 now abandoned.

BACKGROUND OF THE INVENTION

The present invention is concerned with enhancing the appearance of display matrixes in which each pixel comprises an LED lamp. It is also applicable to matrix displays using other types of lamp, such as incandescent filament lamps, and to display panels using lamps that are not necessarily arranged in a uniform manner.

A problem in designing LED lamp matrixes is that of achieving uniformity so that all the lamps give the same light output. The light output of a new LED at a given temperature is dependent on its light efficiency, measured as light intensity at unit current, and on the operating current. Also LEDs are subject to intensity degradation, i.e. fading, with prolonged use.

For most types of LED lamp the light efficiency, often expressed in the form of luminous intensity at 20 mA, can vary from sample to sample by about 5:1. For some types, the diodes are sorted from the production line to have a lower ratio of maximum to minimum light efficiency form sample to sample, for example 2:1.

In an LED matrix with multiplexed drive, current is limited in each LED, usually by means of a resistor that is in series with the LED when it is turned on, and the matrix is preferably driven from a 5 volt supply to avoid reverse breakdown of the LEDs and to keep the power consumption low. The current, I, in a selected LED in such a case is given by:

$$I=(5-V_L)\div R_S$$

where $V_L$ is the forward voltage drop of the LED and $R_S$ is the value of the current limiting resistor. $V_L$ can vary from 1.8 to 3 volts for some types of LED, and using such types the current, I, can vary from a maximum value of $3.2/R_S$ to a minimum value of $2/R_S$, i.e. in the ratio 3.2:2. Thus if the initial light efficiency varies by 2:1, the light output can vary by 3.2:1. Added to this are variations in intensity degradation with time, and variations due to the differences in the voltage drops across the switches routing the currents to the LEDs.

Yet another factor affecting uniformity of an LED display matrix is that the junctions of the LEDs are not all at the same temperature. Those that are on, or have recently been on, are hotter than those that have been off. The difference between the hottest and the coolest junction temperature at any one time can be as much as 50 degrees centigrade. Since the light intensity of an LED can drop by 1% per degree centigrade, this represents a further 2:1 mismatch in intensity. The effect is dynamic. The time constants of junction temperature change can be of the order of a second for the LED itself and tens of seconds for its heat sink, which is typically its printed circuit board.

Not only are there intensity mismatch effects, but there are also color mismatch effects. LED lamps can be initially mismatched in color, when received from the manufacturer, by as much as 11 nanometers in wavelength for some green LEDs. Furthermore, LEDs are subject to dynamic color mismatch, due to dynamic temperature mismatch of the lamps. Further still, LEDs are subject to color degradation, i.e. change of color with prolonged use, which can itself cause color mismatch, since the lamps are not used equally and, in any case, are not guaranteed to have the same rate of degradation.

SUMMARY OF THE INVENTION

In the arts of television and photography an intensity mismatch ratio of 1.05:1 is established as discernible, as is a color mismatch, for green, of 0.7 nanometers. The above discussed variations in LED performance are much wider, and are thus a hindrance to achieving with LED matrixes images of a high quality. It is an object of the present invention to provide an LED display matrix in which all the lamps give the same light output, matched in color as well as in intensity, and free from the dynamic effects, and to achieve these results with a low-cost matrix drive system. It is a further object of the present invention to arrange that the display is as bright as possible in broad daylight, while keeping within the maximum current and junction temperature ratings specified by the LED manufacturer.

The present invention achieves the aforementioned objectives by providing a control system by which the performance the lamps is measured, in some embodiments with the aid of a video or digital camera, and the ambient light falling on the lamps is measured, and the ambient temperature of the lamps, also, is measured. These measurements are used by the control system to optimize the appearance of the display. In one embodiment the differences in light output between the lamps is minimized for all ambient light intensities up to a certain limit. Above this limit uniformity of lamp lighting is partially or wholly sacrificed to achieve maximum brilliance. The control system alters the brightness of each lamp individually by altering the proportion of time for which a register bit that selects the lamp is set. In one embodiment the brightness of the lamp is also dependent on a constant current circuit that delivers to the lamp a current that depends on the ambient temperature of the lamp.

In a further embodiment, for each pixel of a display, the color of a first lamp of the pixel is adjusted by turning on a second, different colored, lamp of the pixel, so as to match all the pixels in color. In yet another embodiment of the invention an electrical characteristic, such as the current, is measured continuously during display, for each lamp. This measurement is used to reduce mismatch between the lamps, in brightness and color, due to unequal temperatures of the lamps.

DESCRIPTION OF PREFERRED EMBODIMENTS

Figure 1:
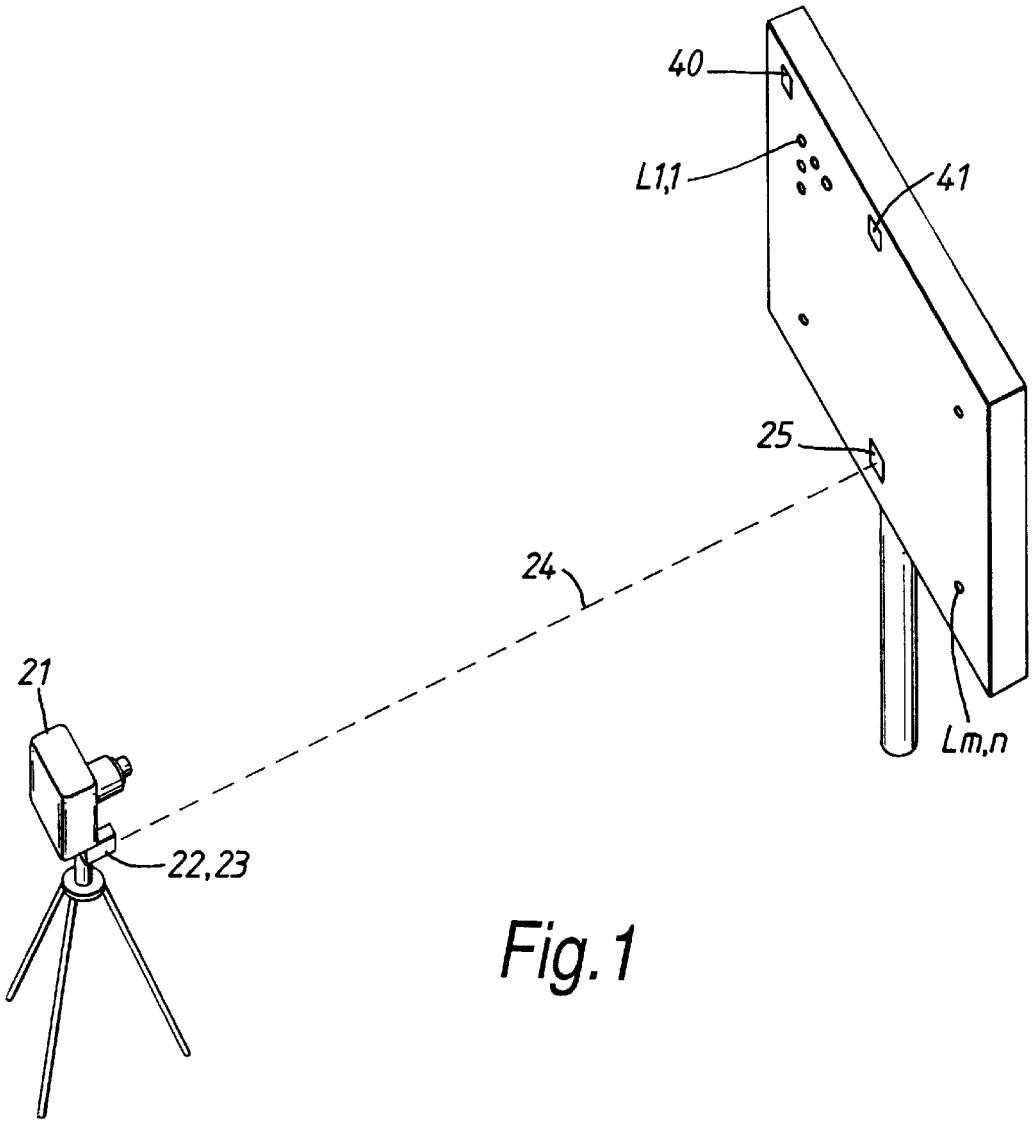
FIG. 1 illustrates setting up a lamp matrix display according to the the invention.
Figures 2, 3A, 3B:
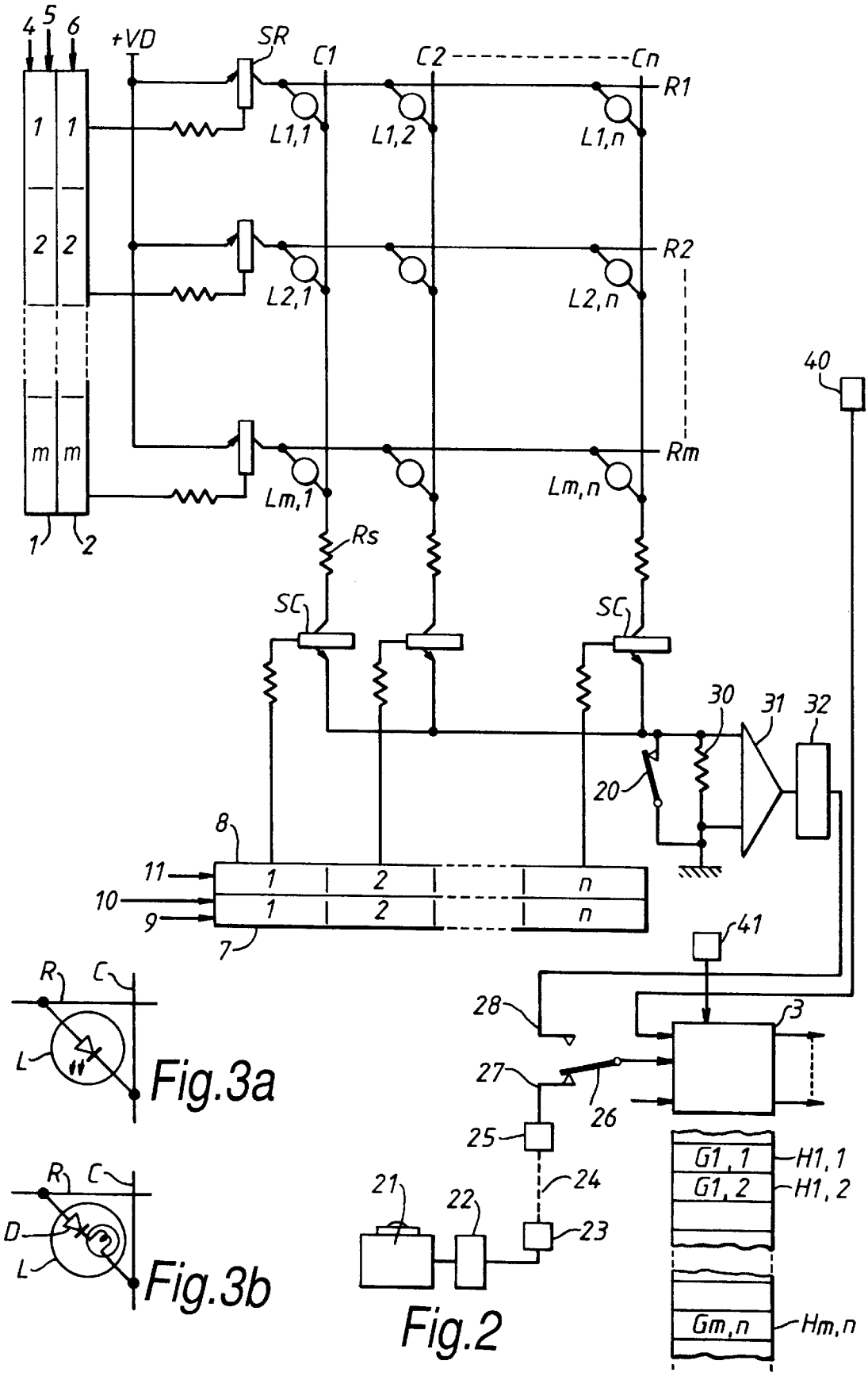
FIG. 2 illustrates the control of the display.
FIGS. 3*a*, 3*b* illustrate two kinds of lamp that can be used in the display.

FIGS. 1 and 2 illustrate an embodiment of the invention comprising a display matrix having m rows and n columns of lamps L. Lamp L comprises a light emitting diode the anode of which is connected to the row conductor R and the cathode to the column conductor C as illustrated in FIG. 3*a*. When a lamp L is energized it constitutes a luminous area. When lamp L is not energized it constitutes a dark area, by contrast with the luminous areas. The lamps are mounted on one or more panels not shown.

Information is displayed on the matrix by driving each row R, in turn, positively for a brief period $T_R$; the drive being repeated continuously in the order 1,2,3, . . . m, 1,2,3, . . . m, 1,2, . . . and so on. Within the period $T_R$ that a row is driven, selected lamps L within the row are illuminated by turning on transistors SC of their associated column conductors C. $T_R$ may be of the order of 0.1 milliseconds.

A row is selected by setting its associated bit within parallel latch register 2 low and the remaining bits high causing the transistor switch for just that row to turn on. The data in register 2 is set up by microprocessor 3, which first loads the data into serial-in parallel-out shift register 1, and then strobes it into register 2 by applying a pulse to terminal 6. Data is loaded into register 1 by means of its serial data input 4 and its clock input 5. Registers 1 and 2 are each of m bits.

Selection of the columns also is under control of microprocessor 3. Microprocessor 3 loads serial-in parallel-out shift register 7 by means of data and clock inputs 9 and 10 respectively, and then transfers the data in register 7 to parallel latch register 8 by a pulse to strobe terminal 11. A column is selected, by its transistor switch SC, when its associated bit in register 8 is high. Current passes from the selected row through lamp L to the column switch SC and then to ground via closed switch 20. Register 8 has a ground terminal, not shown, which can be connected either to ground or to the emitters of transistors SC.

During selection period $T_R$ of a row, microprocessor 3 sets up register 8 256 consecutive times, at the rate of once every $T_A$ seconds, where $T_A=T_R/256$. This is to enable the brightness of each lamp, as perceived by the viewer, to be set to any one of 256 different values. The brightness to which a lamp is set to is dependent on a value of a parameter G particular to the lamp which is held in a location, H, in microprocessor memory that is, also, particular to the lamp. The value of G ranges from 1 to 255. For G=255 the lamp is turned on with maximum brightness as it is turned on for the whole of the row selection period TR. For G=1 the lamp is turned on with minimum brightness.

In general, microprocessor 3 controls the brightness of lamp $L_{x,y}$ (i.e. the lamp at row x, column y) by setting bit y of register 8 high for $G_{x,y}$ consecutive periods $T_A$ during the selection of row x, where $G_{x,y}$ is the value of G stored in memory location $H_{x,y}$ for lamp $L_{x,y}$. Thus the proportion of time for which a bit in register 8 is set to select a lamp determines the brightness of the lamp.

Apart from operating in the display mode described, the display of FIGS. 1 and 2 can also be set to one of two initialization modes, depending on the availability of a light sensing unit 21. If such a unit is used switch 26 is set to position 27 and switch 20 is kept closed. Light sensing unit 21 can be a video camera pointed at the matrix of lamps L. Lamps L are all turned on at maximum brightness by setting G equal to 255 for every lamp. The lamps are turned on briefly, for less than 0.1 seconds, so as not to heat them. The output of video camera 21 is transmitted to microprocessor 3 and the image of the matrix is stored in memory. Transmission from camera 21 to microprocessor 3 is with the aid of an analogue-to-digital converter 22 and infrared transmitter 23, which transmits the digitized image data over optical path 24 to infrared receiver 25. Receiver 25 is attached to the cabinet housing the matrix. Transmitter 23 is attached to the camera or its tripod and aimed at the receiver. Camera 21 may be a digital still camera, in which case converter 22 is not needed. The stored image is analysed by microprocessor 3 to obtain brightness readings for all the lamps. The brightness readings are scanned by microprocessor 3 to determine which lamp L is the least bright, and the brightness of this weakest lamp is taken as a reference brightness. Following this, the brightness reading of each lamp is used by microprocessor 3 to set the G value for the lamp in its memory location H. The value of G being given by:

G=(255×Reference Brightness)÷Brightness reading for the lamp

The value of G is rounded to the nearest whole number. This completes the initialisation process. The camera can be dispensed with and the system is ready for display, with all lamps appearing to have substantially equal brightness. The weaker lamps get more power than the stronger ones to achieve the uniformity. The proportion of time that a lamp is turned on, and therefore the power applied to it, is proportional to the value of G for the lamp.

Initialization can be can be carried out periodically, for example once every year, to compensate for unequal fading of the LED lamps with use. To simplify the software that analyses the information received from the camera, the procedure for measurement can be altered so that each lamp in turn is turned on by itself and a picture taken by the camera while the lamp is on. The pictures can be taken at the rate of several per second. The procedure can be altered so that the camera is pointed at only a quarter of the matrix at a time, if the resolution of the camera is low. To eliminate the effect of ambient light, which may appear as reflections off the face of the sign, on the reading for a pixel, the system can be arranged to measure the light from the pixel both when it is on and when it is off, and to take the difference as being the true reading.

As an alternative procedure, camera 21 can be connected to a laptop computer the display screen of which shows the image viewed by the camera. The laptop computer is used to analyze the light intensities of the pixels and to compute the G values, which are later sent to the display for storage in memory compartments H. Transfer of the G values can be by recording them on a medium which is subsequently read into memory H.

As another alternative, an ordinary film or Polaroid camera can be used for setting up the G values. Two photographs are taken, one with the lamps all on and the other with them off. The photos are analyzed, using a scanner to read them and a personal computer to work out the differences between the photographs and to compute the G values. The G value are subsequently transferred to memory H, which is preferably of the non-volatile type.

The display matrix may be a color one, where a pixel area can be set to any one of a wide range of different colors. In this case three LEDs are used for the pixel; one red, one green, and one blue. The three LEDs may be mounted behind a common diffuser. Alternatively they can be mounted close together so that when viewed at a distance the eye perceives the pixel area to be of only one apparent color, which is the sum of the three emitted colors. For pixel one of row one of the color matrix the three differently colored LEDs are wired as $L_{1,1}$; $L_{1,2}$; $L_{1,3}$ and for pixel two of row one they are wired as $L_{1,4}$; $L_{1,5}$; $L_{1,6}$ and so on along the row. Rows 2 onwards are wired using the same principle. During energization of a pixel, the durations for which its three associated bits in register 8 are set are made dependent not only on the G values, but also on other values held in memory that define the relative intensities of the three pixel lamps needed to achieve the required hue for the pixel. Thus, a required light output $U_{rgb}$ for a pixel is achieved by driving its three LED lamps as follows:

Red lamp: $N_r=G_r.P_r$

Green lamp: $N_g=G_g.P_g$

Blue lamp: $N_b=G_b.P_b$ where $N_r$, $N_g$, $N_b$ are the number of intervals $T_A$ during $T_R$ that the red, green, blue lamps are driven for, respectively; $G_r$, $G_g$, $G_b$ are the G values; for the red, green, blue lamps, respectively; and $P_r$, $P_g$, $P_b$ are values, each not greater than one, held in memory, defining the amount of red, green, blue light, respectively, that the color pixel is required to generate. For example, if the color pixel is required to generate blue-green light at maximum intensity, then $P_r=0$, $P_g=1$ and $P_b=1$. It has been assumed so far that the red lamps are identical in color, and similarly with the green lamps and the blue lamps. The case where for one or more of the three colors the lamps are mismatched both in color and intensity will be discussed later.

During initialization It is possible, instead of using a camera as light sensor 21, to use a photo cell. In this case each lamp in turn is turned on with the photocell receiving light from it and the digital reading for the lamp light is recorded in microprocessor memory.

An alternative to initializing using a camera or a photocell is to measure the LED current, instead of its light output. In this case switch 20 is opened and switch 26 is set to terminal 28. Each lamp L is turned on in turn by selecting just its row and column conductors and a measurement of its current is made with the aid of resistor 30, which may be 1 ohm, and amplifier 31 and analogue-to-digital converter 32. The measurement is stored in a location of memory of microprocessor 3 associated with the lamp. After all the lamp currents have been measured and recorded the measurements are scanned to determine which lamp has the weakest current. This weakest current is established as a reference current. The microprocessor is then used to set up a value for G given by:

G=(255×Reference Current)÷Current measured for the lamp.

After setting up the G values switch 20 is returned to the closed position, ready for display. The system will now compensate for variations in lamp brightness caused by inequalities of the lamp voltage drops and by variations in the transistor voltage drops.

The system in FIG. 2 is arranged to dim all the lamps when the ambient light weakens. A light sensor 40 with digital output is arranged to measure the ambient light and transmit its digital value to microprocessor 3. For low values of sensed ambient light, for example at dusk or at night, microprocessor 3 introduces a time delay between driving each row and the next. This reduces the light output of the display but does not alter the relative brightnesses of the lamps, which are still controlled by the G values.

The lamps L in FIGS. 1 and 2 can each comprise several LEDs connected together in series, to give more power. Alternatively, they can be of another type than LED. For example they can be tungsten filament lamps. A simple way of selecting the tungsten lamps is to provide each with an ordinary diode D in series, as illustrated in FIG. 3*b*. The light output of tungsten lamps can fade with time. This is due to the formation of dark coatings on the inside surfaces of the bulbs after prolonged use, those bulbs that are turned on often becoming darker than those that are not.

Figure 4:
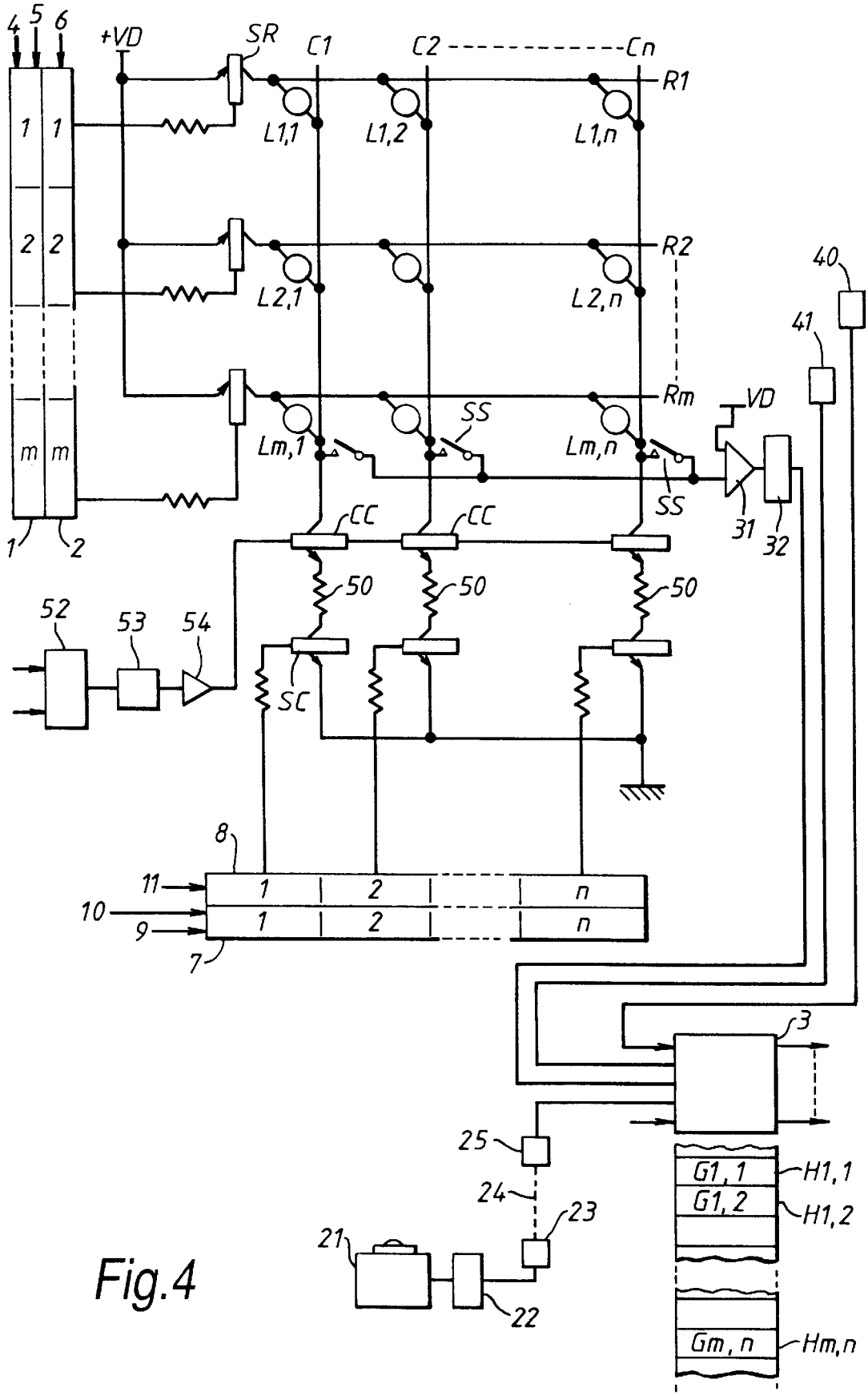
FIG. 4 illustrates an alternative control for the display.

FIG. 4 illustrates another embodiment of the invention. The operation of this with regard to matching the lamps by optical means is the same as that of FIG. 2. The lamps here are driven with constant current the magnitude of which is arranged to vary in accordance with the output of a temperature sensor 41. Temperature sensor 41 is mounted on the display so that it is subjected to the same ambient temperature as the LEDs. The ambient temperature of an LED is taken to mean the temperature of the LED when no electrical power is applied either to it or its neighbors. The output of temperature sensor 41, which can be digital, is fed to microprocessor 3.

Microprocessor 3 is arranged to set up a 4-bit register 52 in accordance with the measured temperature $t_a$. When $t_a$ is below a certain threshold temperature, $t_c$, equal, for example, to 50 degrees centigrade, the value in register 52 is set to fifteen. As the measured temperature ta rises above $t_c$, lower values than fifteen are set up in register 52 by microprocessor 3. The output of register 52 is fed to a digital-to-analogue converter 53, the output of which, in turn, is fed to a unity-gain power amplifier 54. Thus the voltage applied to the bases of transistors CC is controlled by microprocessor 3. When a column C is selected, its transistor CC together with the associated resistor 50 act as a constant current device delivering to the selected LED a constant current that is independent of the voltage drop across the LED and that is dependent on the output voltage of amplifier 54, and, so, adjusted in accordance with the sensed temperature $t_a$. The value of resistor 50 is chosen so that when register 52 is set to fifteen the LED current is the maximum allowed by the LED manufacturer. For sensed temperatures above $t_c$ the value in register 52 is set to the highest value for which the LED junction temperature will not go above a certain limit $t_u$, chosen not exceed the LED manufacturer's maximum junction temperature rating, which is typically 110 degrees centigrade. In this way the daytime brightness of the sign is automatically maximized while keeping within the LED manufacturer's maximum current and temperature ratings. As an example, microprocessor 3 can be arranged, when $t_a$ exceeds $t_c$, to set the contents Y of register 52 according to the formula:

$$Y=15-a(t_a-t_c)$$

where a is a constant of the order of 0.25.

Using camera 21, the arrangement in FIG. 4 can be set to give equal light outputs for all the lamps in the same way as was described in relation to FIG. 2. The arrangement compensates for the effect of variations of the constant currents from column to column, as well as the variations due to differing LED initial light efficiencies and variations that have occurred due to degradation.

In the arrangement in FIG. 2, if the lamps are of the LED type, microprocessor 3 can be arranged to reduce the proportion of time for which lamps L are turned on when the temperature sensed by sensor 41 is high, so as to prevent the LED junction temperatures from exceeding the manufacturer's rating. The reduction of the proportion of time can be achieved by introducing a delay between driving one row and driving the next, as was described before in relation to dimming the display at night.

In a further embodiment of the invention, applicable to both FIG. 2 and FIG. 4, microprocessor 3 is arranged to use light sensor 40 not only to dim the brilliance of the sign as darkness approaches, but also to increase the overall brilliance of the sign under conditions of extreme ambient light, such as strong sunlight falling directly onto the face of the sign. Microprocessor 3 is arranged, on detecting strong ambient light, to cease to drive the lamps so that they have equal light outputs and, instead, to drive each lamp either for the full period $T_R$, to achieve maximum brightness for the lamp, or for the maximum period for which the lamp brightness will not exceed that of any other lamp by a certain factor, for example 2. In this case uniformity is wholly or partially sacrificed in the interest of maximum overall brightness, but only when the ambient light is extreme. When the ambient light falls microprocessor 3 reverts to setting the lamps equal in brightness.

The lamps in the arrangements of FIG. 2 and FIG. 4 need not necessarily be the lamps of a display matrix. They can be the lamps of an instrument display panel. The lamps of the instrument panel may be of different groups each group having its lamps set to a brightness particular to the group. In this case during initialization with camera 21 the lamps of the first group, the group required to have the highest brightness, are turned on at maximum brightness, to determine which lamp within the group is the weakest, and its brightness is taken as the reference brightness, as explained before. The G values of the lamps within the group are then set to give equal brightness of the lamps. Following this, for each remaining group each lamp within the group is assigned a G value given by:

G=[(255×Reference Brightness)÷Brightness reading of the lamp]×$RB_n$ where $RB_n$ is the required ratio of the brightness of the lamps of group n relative to the reference brightness. The values of the constants $RB_1$, $RB_2$, $RB_3$, etc. are permanently held in memory and initially chosen by the designer of the instrument panel. The designer also specifies for each lamp which group it is in, this information being permanently recorded in memory.

The instrument panel may include preprinted light diffusers each provided with a rear lamp which, when lit, causes the printing on the diffuser to become visible. In this case all the back-lit diffusers can be treated as one group, and initialization will result in all the diffusers having an equal brightness, which is predetermined relative to the brightnesses of the other groups. The lamps of the panel need not all be of the same type and they need not all have the same value of current limiting resistor.

In yet another embodiment, using either of the arrangements in FIGS. 2 and 4, the invention is arranged to provide a display that has pixels of matched color using LED lamps that are themselves not matched in color. The embodiment will be described with reference to an RGB color display matrix, on the basis that the green LED lamps are mismatched in color. In this embodiment, when for a color pixel only the color green, with an intensity factor $P_g$, is required, then instead of turning on just the green LED lamp for:

$$N_g=G_g.P_g \text{ periods } T_A$$

during row selection time $T_R$, as described before, the control turns on the red lamp also, for:

$$N_{rgs}=G_r.P_g.Z_{rg} \text{ periods } T_A$$

where $Z_{rg}$ is a color correction factor for the green LED lamp, held in non-volatile memory specifying the proportion of red light that must be added to the light emitted by the green LED lamp to achieve green of the same dominant wavelength (i.e. the same perceived color) for all the pixels. Adding red light in this way matches all the pixels so that they have the same apparent color when they are turned on to green, when their lamps are at the same temperature.

During priming, a color camera, 21, is pointed at the display and the values of $G_r$ for the pixels are established, using the red channel of the camera for light measurement. Similarly, the values of $G_g$ are established using the green channel, and those of $G_b$ using the blue channel. Having equalized the lamps in intensity, the values of $Z_{rg}$ for the pixels are then established as follows. The green LED lamps are turned on, one at a time, several at a time, or all simultaneously, at the same light intensity, $W_{ge}$. For each pixel the intensity, $W_{rg}$, of red light emanating from the green LED lamp is measured, using the red channel of the camera, and recorded. The values of $W_{rg}$ are then scanned to find $W_{rg}$(max), corresponding to the pixel for which the green LED lamp generates the most red light. The color of this lamp is taken to be a reference color. For each pixel, the value of $Z_{rg}$ is evaluated by:

$$Z_{rg}=[W_{rg}(\max)-W_{rg}]/W_{ge}$$

and stored in non-volatile memory. By this expression all pixels turned on to green will emit light having the same proportion, $W_{rg}(\max)/W_{ge}$, of red to green light as the reference color.

Blue can be used instead of red to match the green lamps in color. Alternatively, blue can be used to correct the green lamps that have more than a chosen amount of red; and red to correct the remainder of the green lamps. In matching the pixels, a lamp of standard intensity and color, measured by the same means as the lamps of the matrix, can be used as the reference to which the lamps of the matrix are set, instead of using selected lamps of the matrix as reference. In this way all displays made can be matched to a common reference. Color matching can be applied to the red lamps and to the blue lamps, using green in each case.

The color correction system just described can be used to match in color the pixels of a monochrome display. Thus, for example, the pixels of a yellow LED monochrome display may each be provided with a red LED surrounded by a number of the yellow LEDs, the red LED being used to standardise the hue of the pixel in the manner described above, making all the pixels the same apparent shade of yellow when viewed from a distance.

If the LED lamps are subject to color degradation, i.e. change of color with use, the lamps may cease to be adequately matched in color after a time. Color mismatch due to color degradation can be reduced by repriming from time to time.

LED matrixes are subject to dynamic variations in the light intensities of the lamps caused by transient thermal effects as messages displayed are changed. As the temperature rises, the light output drops by a factor J. J can be of the order of 0.01 per degree centigrade for some LEDs.

As a further embodiment of the invention, the display system is arranged to correct for the dynamic variation by altering the drive to each LED lamp by a temperature dependent dynamic intensity factor:

$$E=1/(1-J.\Delta t)$$

where Δt is the change in temperature, t, of the lamp. The temperature of the lamp is the temperature at its junction.

Using the basic arrangement of FIG. 2, the value of E for each lamp is determined by measuring its current, I, both during priming time, when the lamps are all at the same temperature tp, and during display, when the lamps are at different temperatures. This is explained as follows. Assuming switches SR, SC to be ideal switches, for example mosfet transistors with negligible "on" resistance, and neglecting the effect of measuring resistance 30, the current I of a selected lamp is given by:

$$I=(V_D-V_L)/R_S$$

where $V_L$ is the voltage across the lamp. The values of $V_D$ and $R_S$ are independent of temperature, and so, the change, ΔI, of lamp current due to change, Δt, of lamp temperature is given by:

$$\Delta I/\Delta t=-(\Delta V_L/\Delta t)/R_S$$

For an LED lamp ($\Delta V_L/\Delta t$) is a constant, B (equal approximately to—0.002 volts per degree centigrade), and so:

$$\Delta I/\Delta t=-B/R_S$$

from which:

$$\Delta t=-\Delta I.R_S/B$$

and substituting this in the expression for E, one gets:

$$E=1/(1+\Delta I.R_S.J/B) \quad (1)$$

The procedure for evaluating and employing the correction factor E for each lamp, using the arrangement in FIG. 2, is as follows. As a prelude to priming, the display is blanked for a minute or more to allow all lamps L to reach the same steady temperature $t_p$. The G values are then established, for example using camera 21 as described before, taking care that the lamps are driven only briefly so as not to alter their temperatures. After the G values have been established, switch 20 is opened and switch 26 set to position 28 and each lamp L is turned on in turn, briefly so as not to alter its temperature, and its current, $I_p$, is measured and recorded in non-volatile memory. The temperature, $t_p$, at which the priming of the display has been carried out is read from sensor 41 and recorced in non-volatile memory. Switch 20 is preferably of the mosfet type.

During display, switch 26 is set to position 28 and the following procedure is carried out each time a row R is selected:

a) Switch 20 is opened and the current, I, of each lamp of the row is rapidly measured and temporarily recorded. This is done shifting a "one" along register 8. Because of the rapidity of measurement, the resultant light from the lamps is too weak to be seen.

b) For each lamp in the row, the value of E is calculated by microprocessor 3 from:

$$E=1/\{1+[I-I_p].R_S.J/B\} \quad (2)$$

and temporarily stored. This expression is derived from equation (1).

c) Switch 20 is closed by microprocessor 3 and the row is driven for display with, for each lamp, the value A.E.G being used instead of G. By inclusion of the factor E, brilliance mismatch due to temperature differences between the lamps is now eliminated. The factor A is the same for all the lamps. A is chosen so that A.E cannot exceed unity. For example, it can be chosen to be 0.5.

By the above process, the light output is independent of both the ambient temperature and differences in temperature between lamps.

The value of J/B for a given LED can be determined at the end of priming by measuring the current $I_p$ and the brightness $W_p$ for the lamp at temperature $t_p$, then driving the lamp strongly for a few seconds to raise its (junction) temperature to some unknown value, $t_u$, and measuring the current $I_u$ and the brightness $W_u$ at this unknown temperature. The values are interrelated as follows:

$$1-W_u/W_p=J.(t_u-t_p)(I_u-I_p).R_S=B.(t_u-t_p)$$

from which:

$$J/B=(1-W_u/W_p)/(I_u-I_p).R_S$$

The value for J/B is computed from this last expression. J/B can be determined and stored for each lamp individually.

As a modification of the above process, it is possible to allow the brightness of the display to diminish with ambient temperature rise while still eliminating lamp brightness variations that are due to lamp temperature differences. In this case the following value, E', is used in place of E in step (b) above:

$$E'=1/\{1+[I-I_p+(t_a-t_p).B/R_S]R_S.J/B\} \quad (3)$$

where $t_a$ is the ambient temperature read from sensor 41 during display. The third term in the square bracket represents the effect on lamp current of changing the ambient temperature of the display from $t_p$ to $t_a$.

LED matrixes are subject to dynamic variations in the colors of the lamps, caused by the dynamic junction temperature changes. The effect is more noticeable with green and yellow lamps. These shift their color towards red as the temperature rises.

An embodiment of the invention providing intensity matching, dynamic intensity matching, color matching and dynamic color matching will now be discussed for an RGB display using the arrangement in FIG. 2 and having three LEDs per color pixel, one for each color. It is assumed that color matching is required only for the green lamps. In this case a color pixel is driven as follows:

$$N_r=E_r.A.[G_r.P_r+G_r.P_g(Z_{rg}+Z_{rgd})]$$

$$N_g=E_g.A.[G_g.P_g]$$

$$N_b=E_b.A.[G_b.P_b]$$

where $E_r$, $E_g$, $E_b$ are the E values for the red, green and blue lamp of the pixel, respectively. The new term, $Z_{rgd}$, is a dynamic color correction factor, given by:

$$Z_{rgd}=(t_a+t_{mr}-t).Q$$

where $t_{mr}$ is a design allowance, for example 50 degrees, for the maximum expected temperature rise of the junction temperature above ambient, $t_a$, and where t, as before, is the lamp temperature. Q is a constant defining the change in the proportion of red to green light generated by the green lamp that occurs when its temperature rises one degree. As its temperature, t, rises, the green lamp generates more red but, by $Z_{rgd}$, the red lamp gives less red, keeping the proportion of total red to green independent of temperature. $Z_{rgd}$ can be re-expressed as:

$$Z_{rgd}=[(t_a-t_p+t_{mr})-(t-t_p)].Q$$

Since lamp temperature change $\Delta t$ is related to lamp current change $\Delta I$ by:

$$\Delta t=\Delta I.R_S/B,$$

then $(t-t_p)$ can be replaced, to give:

$$Z_{rgd}=(t_a-t_p+t_{mr}).Q-(I-I_p).Q.R_S/B$$

from which:

$$Z_{rgd}=[(t_a-t_p+t_{mr}).S.B/R_S]-(I-I_p).S \quad (4)$$

where:

$S=Q.R_S/B$

The value of S for a pixel can be determined at priming time by energizing the green lamp to determine its current, $I_p$, its green light, $W_{gp}$, and its red light, $W_{rgp}$, when its junction temperature is $t_p$; and then its current, Iu, its green light, $W_{gu}$, and its red light, $W_{rgu}$, when the junction is at higher temperature $t_u$. The value of S is computed from:

$$S=[W_{rgu}/W_{gu}-W_{rgp}/W_{gp}]/(I_{gu}-I_{gp})$$

and stored in non-volatile memory. The expression in the square bracket is the change in the proportion of red to green light between the two sets of measurements.

The value of $Z_{rgd}$ for a pixel is computed from equation (4). The factor in the square brackets in equation (4) is slow changing and can be evaluated once every minute. The other factor, $(I-I_p).S$, is computed every ten milliseconds or so, as is the value of $Z_{rgd}$.

As an alternative, dynamic color correction of the green can be provided by adding blue light to the pixel that increases with temperature, instead of adding red light that diminishes with temperature.

The RGB display can be reprimed, once a year for example, to reduce unevenness due to color degradation, as well as unevenness due to intensity degradation.

The dynamic compensation described so far is applicable to displays for which the voltage-current characteristics of the lamps do not change significantly due to degradation that occurs between one priming time and the next.

If the lamps used are of a type that exhibits marked change of voltage-current characteristics with degradation then, to minimize the effect of degradation on the accuracy of dynamic compensation without having to prime frequently, the system is arranged to repeatedly test itself once every day at 3 AM. At this time the display is blanked for a minute or more to allow the lamps all to cool to the same temperature, $t_m$, given by temperature sensor 41. Temperature $t_m$ is recorded and the lamp current, $I_m$, is measured and recorded for each lamp. During subsequent display $I_m$ is used in place of $I_p$ in equation (2), or its alternative, equation (3), in step (b) of dynamic intensity correction. $I_m$ is also used in place of $I_p$ in equation (4) for the dynamic color correction factor $Z_{rgd}$. As a bonus, the system can in this case detect degradation in a lamp without rerpriming. The system compares $I_m$ with $I_p$ and if it is found that $$I_m<[I_p+(B/R).(t_m-t_p)]$$

then the internal resistance of the lamp has increased, indicating degradation. The brightness of the lamp can be turned up by the system by an amount dependent on the difference between the two sides of the equation so as to reduce differences in the brightnesses of the lamps the are due to inequalities in their degradations.

It is possible to provide dynamic compensation by measuring the lamp voltages instead of their currents, since $\Delta V=-\Delta I.R_S$. In the arrangement in FIG. 4, by driving a lamp and closing switch SS of its column, the voltage of the lamp can be read, via amplifier 31 and analogue to digital converter 32. Switches SR and SS are in this case preferably of the mosfet type, having minimal voltage drop.

For each of the arrangements of FIG. 2 and FIG. 4 it is possible to replace camera sensor 21 with a single photosensor, such as a phototransistor, the output of which is fed to a tuned circuit, such as a one megacyde crystal, which feeds a demodulator. In this case, for measurements during priming, lamps L are energised only one at a time each with a pulse train of one million pulses per second.

Figure 5:
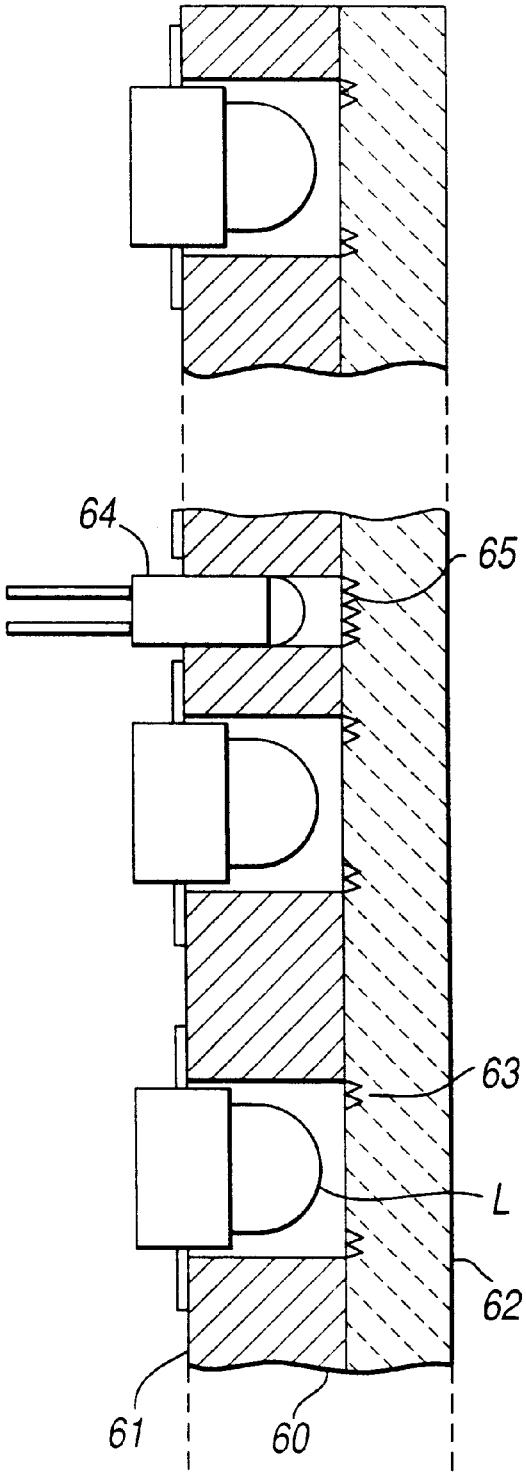
FIG. 5 illustrates in cross section an arrangement for sensing light from the lamps.

Lamps L may be mounted on tiles that are butted together, with each tile having, for example, a 16×16 matrix of lamps. Tile 60 illustrated in FIG. 5 includes lamps L soldered to the back of a printed circuit board 61 and a translucent light-guide sheet 62 mounted at the front of the board. Sheet 62 has a light disperser 63 opposite each lamp L and a light disperser 65 opposite a phototransistor 64 mounted at the center of the tile to receive light from sheet 62. Dispersers 63, 65 may comprise facets, grooves or roughened surfaces in sheet 62. The output of photosensor 64 is fed via suitable electronics to a filter that passes only one megacycle. At 3 AM each day the system is arranged to energize each lamp in turn at one million pulses per second and to measure the output of the filter circuit during such energization and to record the measurement and ascertain if there has been any change in the light output of the lamp due to degradation, relative to an earlier measurement made by the same procedure, and to correct for the detected change of light. Sensor 64 may be replaced with a fiber optic guide that transmits light from the tile to a sensor that is common to all of the tiles. Alternatively, each tile may be provided with two fiber optic guides each used to sense lamps on the tile that are not close to it. By this means, together with appropriate individual tailoring of each lamp disperser 63, it is possible to achieve sensing of the lamps that is fairly independent of lamp position on the tile, enabling the sensing system to be used for initial priming without having to use different multiplication factors to compensate for differences in light transmission between the lamps and disperser 65. The common sensor for all the fiber light guides can be a unit arranged to measure red, green and blue components of light separately.

Shift registers 1 and 7 can be replaced with gates arranged for rapid loading of drive registers 2 and 8 with bytes or words directly from microprocessor 3 or any external memory connected to it.

Information, such as Pr, Pg, Pb, specifying what a pixel is required to display is classified here as command information. By contrast, information or parameters relating to properties of the lamps, such as temperature, current, G value, B value, Zrg value, E value, etc., of the lamp is classified here as physical informaton.

What is claimed is:

1. A display system comprising a matrix of display pixels each comprising solid-state lamp means having different properties individual to the corresponding pixel, said display system comprising:

storage means permanently storing for each of said lamp means individually physical information derived by measurement of at least one of the current of the lamp means and light generated by the lamp means;

a plurality of transistors each operable to drive a corresponding one of the lamp means in a row of said matrix;

a plurality of single-bit memory elements each of which controls an associated one of said plurality of transistors;

a microprocessor for outputting for each of said memory elements a serial data stream that is loaded into the memory element, the serial data stream being dependent on the physical information of a lamp means that is driven under control of the memory element; and means for reducing differences in the appearances of said matrix pixels that are due to differences in the properties of the corresponding lamp means.

2. A display system according to claim 1 arranged to measure the current of said one of said lamp means including a resistor through which the current of the lamp means is passed, said resistor being shunted with a switch.

3. A display system according to claim 1 arranged to automatically measure from time to time at least one of the currents, the voltages, and the light intensities of said lamp means.

4. A display system according to claim 1 including, at least temporarily, light-sensitive means means exposed for said measurement to a plurality of said areas simultaneously.

5. A display system according to claim 1, wherein each said pixel comprises first and second lamp means having respective first and second nominal colors, said display system further including means defining a reference color for said first lamp means and storage means for each of said first lamp means storing color related physical information indicative of deviation of the color of the lamp means from said reference color, said display system reducing differences in the apparent colors of the pixels that are due to differences in the colors of the first lamp means of the pixels by supplementing for each pixel the light of the first lamp means of the pixel width an amount of light from the second lamp means of the pixel, the amount of light being dependent on said color-related physical information for the first lamp means of the pixel.

6. A display system according to claim 1, further comprising a camera positioned for capturing at least one picture of the pixels of said matrix and the output of which determines the physical information for each of said lamp means of said matrix.

7. A display system according to claim 1, wherein said microprocessor is connected to said storage means.

8. A display system according to claim 1, wherein each of said lamp means comprises an LED lamp and said display system further includes means for detecting for each of said lamp means an individual change in at least one of the voltage and the current of the lamp means caused by change of junction temperature of the lamp means, said display system further including means for reducing differences in the appearances of said pixels that are due to differences in the junction temperatures of their respective lamp means.

9. A display system according to claim 1, further including a sensor for detecting ambient light, and means for reducing the extent of said reduction of differences in the appearances of said pixels when the ambient light is strong, whereby during strong ambient light uniformity of said pixels is at least partly sacrificed so as to increase their average brightness.

10. A display system according to claim 1, wherein at least part of said physical information is derived using light-sensitive means for measuring light from said lamp means.

11. A display system according to claim 1, wherein said physical information is derived by measurement employing said transistors.

12. A display system according to claim 1, wherein the stored physical information for said lamp means is unrelated to the value of command information for that lamp means.

13. A display system comprising a matrix of display pixels each comprising solid-state lamp means having a degradation rate individual to the corresponding pixel, said display system comprising:

storage means permanently storing for each of said lamp means individual physical information derived by measurement of at least one of the current of the lamp means and light generated by the lamp means;

a plurality of transistors each operable to deliver a rectangular pulse of current to a corresponding one of the lamp means in a row of said matrix;

a plurality of single-bit memory elements each of which controls an associated one of said transistors;

control means for preparing for each of said memory elements a serial data stream that is loaded into the memory element, the serial data stream being dependent on the physical information of a lamp means that is driven under control of the memory element; and means for repriming the display system for reducing differences in the appearances of said matrix pixels that are due to differences in the degradation rates of corresponding lamp means.

14. A display system according to claim 13, wherein said serial data stream comprises identical binary digits the number of which is proportional to the physical information.

15. A display system according to claim 13, wherein said storage means is nonvolatile and the contents thereof can be overwritten and wherein said display system further comprises means for operating the display system in a priming mode in which physical information is altered to correct for performance changes of the lamp means of the pixels that occur during the life of the display system.

16. A display system, comprising:

a matrix of display pixels each comprising solid state lamp means individual to the pixel, the brilliance of each of said lamp means being individually adjustable;

means for permanently storing physical information for each of said lamp means individually and permanently installed means common to all of said lamp means for measuring light from each of said lamp means;

means for switching the display system occasionally into a priming mode in which the physical information is automatically re-established using said common measuring means; and means for reducing differences in the appearances of said matrix pixels during display that are due to differences in the properties of their respective lamp means.

17. A display system comprising a matrix of display pixels each comprising solid-state lamp means individual to the pixel, said display system, comprising:

means permanently storing physical information for each of said lamp means individually, derived by measurement of light generated by the lamp means;

a plurality of transistors each operable to deliver current to a corresponding one of the lamp means in a row of said matrix;

a plurality of single-bit memory elements each of which controls an associated one of said transistors;

control means for preparing for each of said memory elements a serial data stream that is loaded into the memory element, the serial data stream being dependent on the physical information of said lamp means that is driven under control of the memory element;

a camera positioned for taking at least one picture of said matrix the output of which determines said permanently-held physical information for each of said lamp means; and means for reducing differences in the appearances of said matrix pixels that are due to differences in the properties of the respective associated lamp means caused by degradation of the lamp means.

18. A display system comprising a matrix of display pixels each comprising solid-state lamp means individual to the pixel, said display system comprising:

means for permanently storing physical information for each of said lamp means individually;

a camera pointed at said matrix for capturing a picture of the respective pixels thereof, said physical information being dependent on output from said camera; and means for reducing differences in the appearances of said matrix pixels that are due to differences in the properties of their respective lamp means.

19. A display system according to claim 18, wherein the physical information for one of said lamp means is dependent on the difference between a brightness reading for the lamp means taken with said camera with the lamp means on and a brightness reading for the lamp means taken with said camera with the lamp means off.

20. A display system comprising a matrix of display pixels each comprising solid-state lamp means each having a corresponding degradation rate individual to the pixel, each lamp means being turned on in response to command information (P) defining the brightness required of the lamp means, said display system comprising:

storage means permanently storing for each of said lamp means individual physical information derived by measurement of at least one of the current of the lamp means and light generated by the lamp means;

a plurality of transistors each operably to deliver a rectangular pulse of current to a corresponding one of the lamp means in a row of said matrix;

a plurality of single-bit memory elements each of which controls an associated one of said of transistors;

control means for preparing for each of said memory elements a serial data stream that is loaded into the memory element, the serial data stream being dependent on a function of the physical information of a lamp means that is driven under control of the memory element and the command information for that lamp means; and means for repriming said display system so as to reduce differences in the appearances of said matrix pixels that are due to differences in the degradation rates of the corresponding lamp means.

* * * * *

Disclaimer

6,081,073—Hassan Paddy Abdel Salam, London (GB). MATRIX DISPLAY WITH MATCHED SOLID-STATE PIXELS. Patent dated June 27, 2000. Disclaimer filed July 22, 2014, by the inventor.

Hereby disclaim complete claims 1-20, of said patent.

(*Official Gazette, February 24, 2015*)